US006109685A

United States Patent [19]

Lindsey et al.

[11] Patent Number: 6,109,685

[45] Date of Patent: Aug. 29, 2000

[54] LOUNGE CHAIR

[76] Inventors: Donna L. Lindsey, 78 Oak St., Apt. #D, Middleboro, Mass. 02346; Donald R. James, 18 Cypress pont, Cummaquid, Mass. 02630

[21] Appl. No.: 09/421,749

[22] Filed: Oct. 20, 1999

[51] Int. Cl.[7] ..... A47C 4/44; A47C 5/10

[52] U.S. Cl. ..... 297/40; 297/900; 297/411.39; 297/411.4

[58] Field of Search ..... 297/16.1, 40, 900, 297/411.4, 411.38, 411.39, 173; 5/623

[56] References Cited

U.S. PATENT DOCUMENTS

| | | | |
|---|---|---|---|
| 229,906 | 7/1880 | Mosler et al. | 297/40 |
| 588,108 | 8/1897 | Haswell | 297/173 X |
| 1,271,515 | 7/1918 | Murray | 297/184.11 X |
| 3,661,421 | 5/1972 | Johnson . | |
| 3,774,965 | 11/1973 | Brandt et al. | 297/411.39 X |
| 3,897,102 | 7/1975 | Lemaire . | |
| 4,017,118 | 4/1977 | Cawley . | |
| 4,351,562 | 9/1982 | Twitchell et al. | 297/411.39 X |
| 4,421,358 | 12/1983 | Lehnen | 297/411.4 |
| 4,639,036 | 1/1987 | Nichols | 297/173 X |
| 4,768,797 | 9/1988 | Friedrich . | |
| 4,832,406 | 5/1989 | Adams et al. . | |
| 4,941,222 | 7/1990 | Prager | 5/111 |
| 5,255,956 | 10/1993 | Stevens . | |
| 5,297,850 | 3/1994 | Guleserian . | |
| 5,407,249 | 4/1995 | Bonutti . | |
| 5,466,039 | 11/1995 | Umbranna | 297/900 X |
| 5,597,208 | 1/1997 | Bonutti . | |
| 5,752,683 | 5/1998 | Novis et al. . | |
| 5,765,909 | 6/1998 | Catrinar | 297/173 X |
| 5,947,561 | 9/1999 | Ryan | 297/900 X |

FOREIGN PATENT DOCUMENTS

| | | | |
|---|---|---|---|
| 2335338 | 1/1974 | Germany | 297/16.1 |
| 3008600 | 9/1981 | Germany | 297/411.39 |

*Primary Examiner*—Peter M. Cuomo
*Assistant Examiner*—David E. Allred
*Attorney, Agent, or Firm*—Steven N. Fox; Hancock & Estabrook, LLP

[57] ABSTRACT

The present invention is a lounge chair that may be used by a person to comfortably lie on her back or stomach while supporting her arms and/or hands. In one embodiment, the lounge chair comprises a median member having a first end portion and a second end portion. The lounge chair further comprises a lower member and an upper member rotatably engaged with the first and second end portions of the median member, respectively. The lounge chair further comprises an arm support member rotatably engaged with the upper member. The arm support member comprises first and second arm portions disposed at opposite ends of the upper member. In operation, a person may rotate the upper member and arm support member from a first or inclined position wherein the upper member is substantially vertical to the median member and the arm support member is parallel to the median member thereby allowing a person to sit upright while comfortably supporting her arms and/or hands on the first and second arm portions to a second or flat position wherein both the upper member and the arm support member are parallel with the median member thereby allowing a person to lie on her stomach while comfortably supporting her arms and/or hands on the first and second arm portions.

3 Claims, 5 Drawing Sheets

LOUNGE CHAIR

FIELD OF THE INVENTION

The present invention relates generally to the field of lounge chairs.

BACKGROUND OF THE INVENTION

FIG. 1 illustrates a conventional lounge chair 10 which is often used at a beach or a pool by a person. Lounge chairs of this type generally comprise a lower end portion 12 adjustably engaged with one end of a median portion 14 about a locking mechanism 16, an upper end portion 18 engaged with the other end of the median portion 14 about a locking mechanisms 20, and leg members 22 and 24 engaged with the rod members 16 and 20, respectively. Lower end portion 12, median portion 14 and upper end portion 16 are made from tubular frames and a backing material such as plastic or nylon strips dressed across the tubular frame. Such conventional lounge chairs while serving many useful purposes have several drawbacks. For example, such lounge chairs are uncomfortable to use when a person is lying on her stomach because there is no place to support the person's arms and/or hands.

SUMMARY OF THE INVENTION

The present invention is a lounge chair that may be used by a person to comfortably lie on her back or stomach while supporting her arms and/or hands. In one embodiment, the lounge chair comprises a median member having a first end portion and a second end portion. The lounge chair further comprises a lower member and an upper member rotatably engaged with the first and second end portions of the median member, respectively. The lounge chair further comprises an arm support member rotatably engaged with the upper member. The arm support member comprises first and second arm portions disposed at opposite ends of the upper member. In operation, a person may rotate the upper member and arm support member from a first position wherein the upper member is substantially vertical to the median member and the arm support member is parallel to the median member thereby allowing a person to sit upright while comfortably supporting her arms and/or hands on the first and second arm portions to a second position wherein both the upper member and the arm support member are parallel with the median member thereby allowing a person to lye on her stomach while comfortably supporting her arms and/or hands on the first and second arm portions.

BRIEF DESCRIPTION OF THE DRAWINGS

The following detailed description of the invention will be better understood with reference to the accompanying drawing wherein.

DETAILED DESCRIPTION OF THE PREFERRED EMBODIMENT

Figure 1:
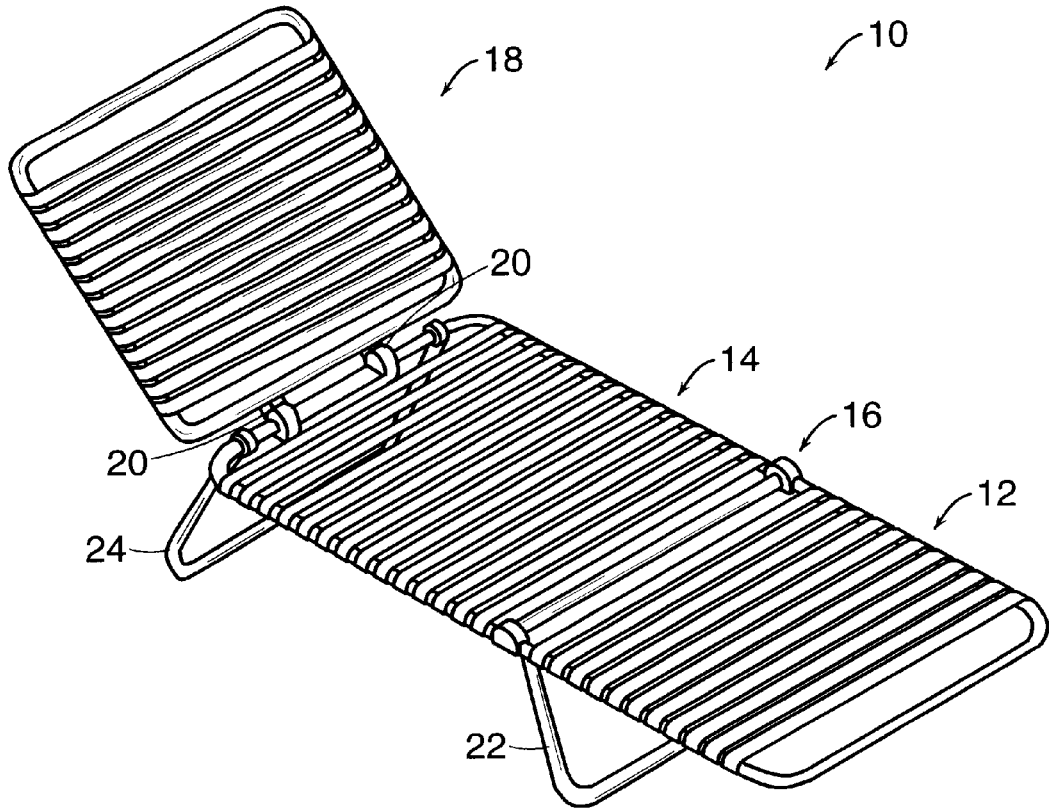
FIG. 1 PRIOR ART
FIG. 1 is a perspective view of a conventional lounge chair.
Figure 2:
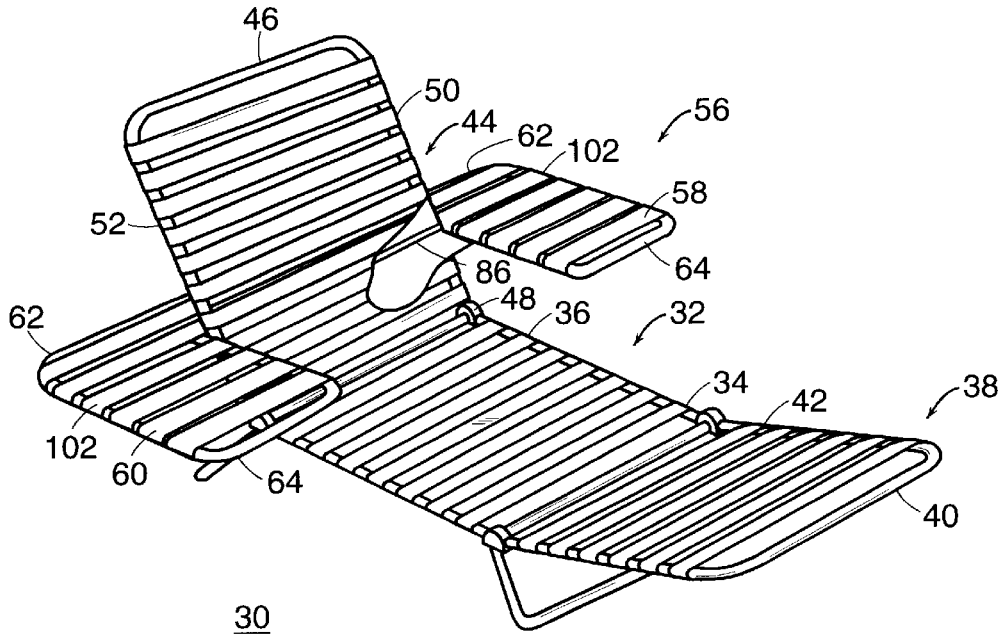
FIG. 2 is a perspective view of a first embodiment of a lounge chair of the present invention shown in an upright position wherein a person might typically lie on her back.
Figure 3:
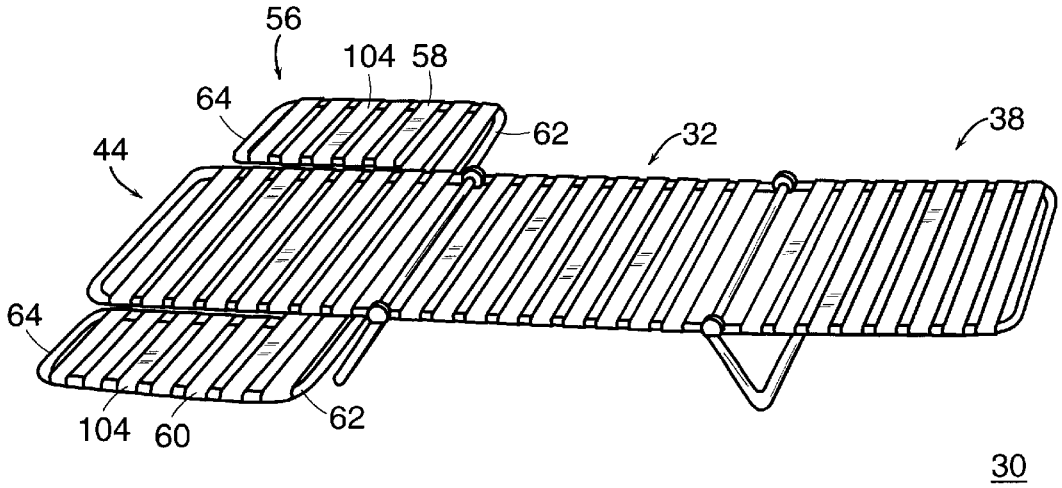
FIG. 3 is a perspective view of the first embodiment of the lounge chair shown in a flat position wherein the person may lie on her stomach.
Figure 4:
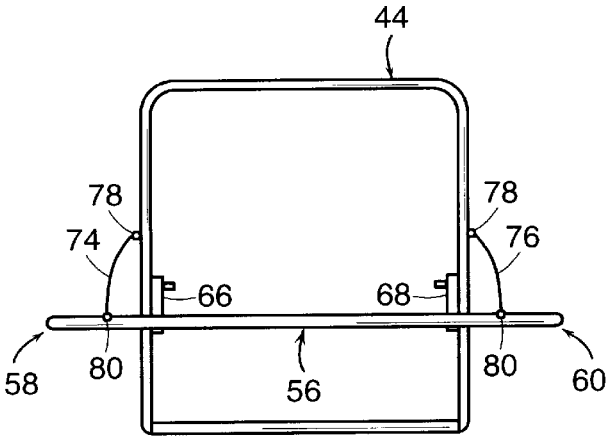
FIG. 4 is rear view of the first embodiment of the lounge chair showing the arm support member engaged to the upper portion of the lounge chair.
Figure 5:
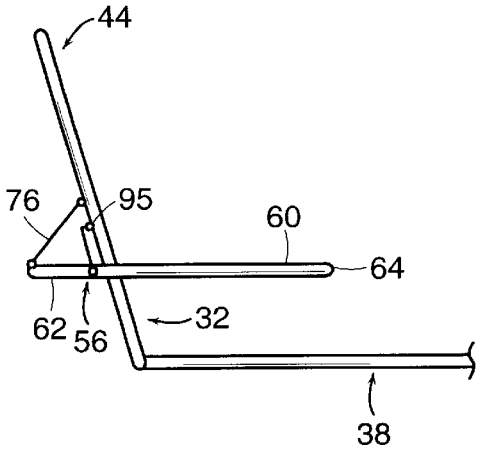
FIG. 5 is a side view of the first embodiment of the lounge chair shown in an inclined position.
Figure 6:
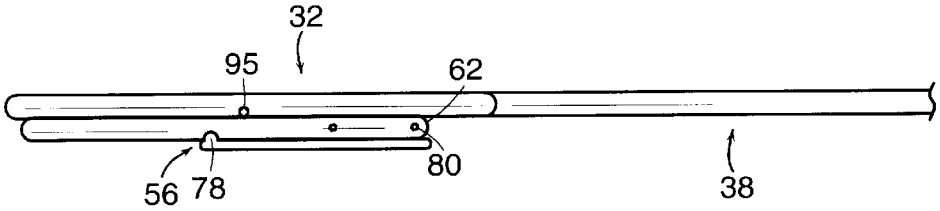
FIG. 6 is a side view of the first embodiment of the lounge chair shown in a flat position.
Figure 7:
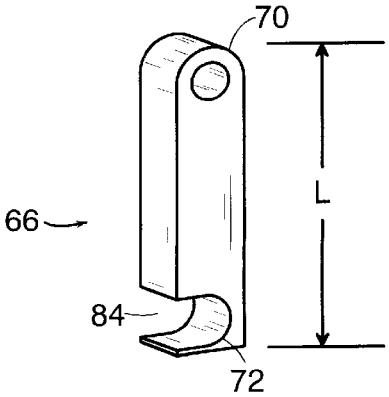
FIG. 7 is a perspective of the cantilever member.

Referring to FIGS. 2–3, the lounge chair 30 of the present invention generally comprises a median member 32 having a first end portion 34 and a second end portion 36. The lounge chair 30 further comprises a lower member 38 having a first end portion 40 and a second end portion 42 engaged with the first end portion 34 of the median member 32. The lounge chair 30 further comprises an upper member 44 having a first end portion 46 and a second end portion 48 engaged with the second end portion 36 of the median member 32. The upper member 44 further comprises first and second side portions 50 and 52.

Figure 10:
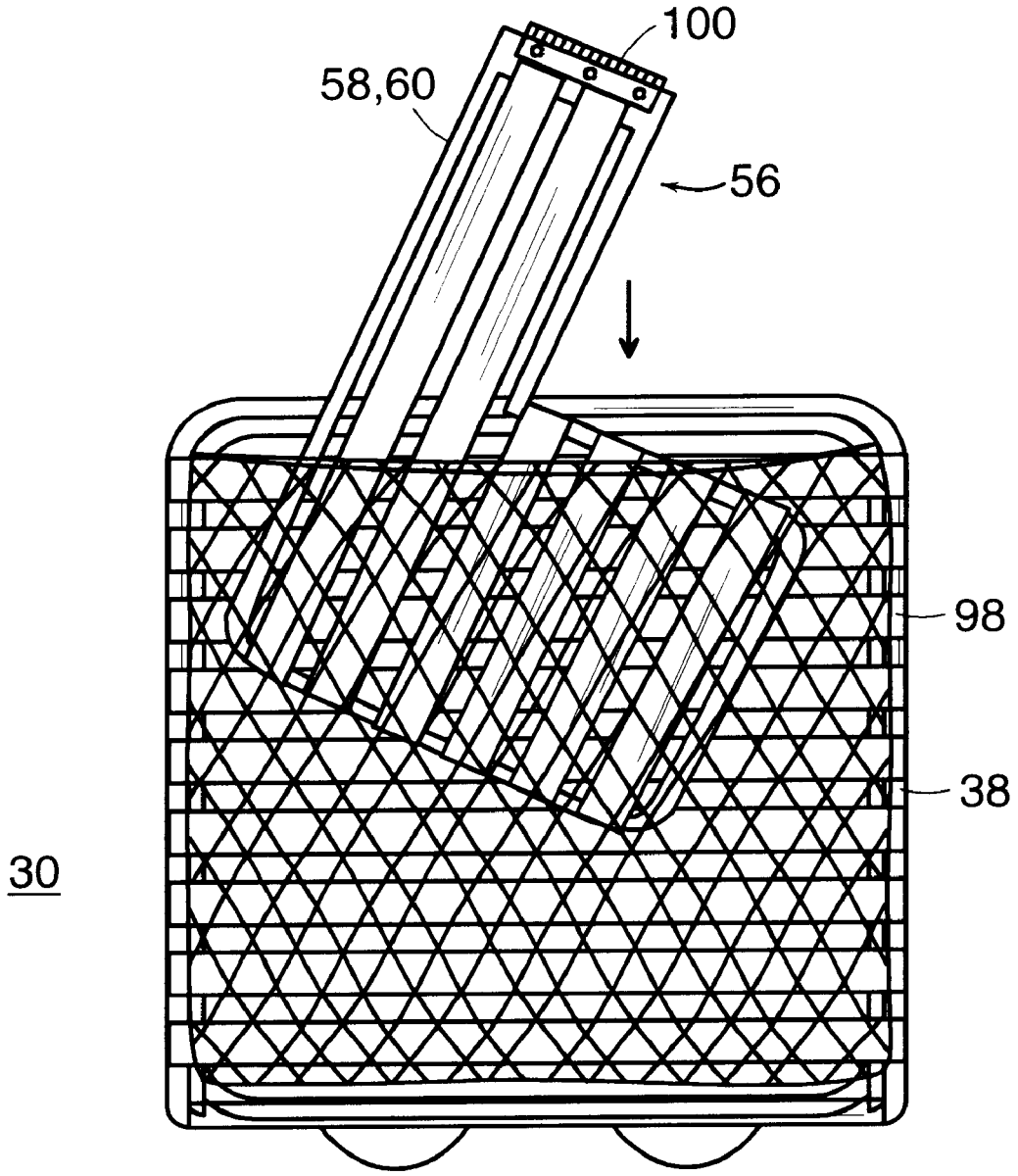
FIG. 10 is a perspective view of another embodiment of the lounge chair of the present invention showing the addition of a pouch affixed to the lower member for storing the arm support member during storage and/or transportation of the lounge chair.

The lounge chair 30 further comprises an arm support member 56 moveably engaged with the upper member 44. The arm support member 56 comprises first and second arm portions 58 and 60 disposed adjacent to the first and second side portions 50 and 52 of the upper member 44, respectively. Each of the first and second arm portions 58 and 60 comprise first and second end portions 62 and 64. The arm support member 56 further comprises a front portion 86 disposed between the end portion 64 of the arm portions 58 and 60, respectively. The first and second arm portions 58 and 60 each comprise a first surface 102 and a second surface 104. The first and second surfaces 102 and 104 are substantially adjacent and parallel to each other. As shown in FIG. 10, the first and second arm portions 58 and 60 may be folded about a hinge 100.

Referring to FIGS. 4–7, wherein the lounge chair 30 is shown further comprising a first adjustment member 66 and a second adjustment member 68. Each of the first and second adjustment members 66 and 68 have a first end portion 70 and a second end portion 72. With respect to the first adjustment member 66, the first end portion 70 is rotatably engaged with the upper member 44 about pivot point 95 while the second end portion 72 is rotatably engaged with the end portion 62 of the first arm portion 58. With respect to the second adjustment member 68, the first end portion 70 is rotatably engaged with the upper member 44 while the second end portion 72 is rotatably engaged with the end portion 62 of the second arm portion 60. The first and second adjustment members 66 and 68 further comprise a channel portion 84 which is adapted to receive and capture the front portion 86 of the arm support member 56. In one embodiment, the front portion 86 of the arm support member 56 could be snap-fit into the channel portion 84. In another embodiment, the channel portion 84 could be provided with a spring loaded cover to allow insert and extract the front portion 86 with the channel portion 84. The length L of the first and second adjustment members 66 and 68 fix the radius of rotation between the upper member 44 and the first and second arm portions 58 and 60.

The lounge chair 30 further comprises first and second support members 74 and 76. Each of the first and second support members 74 and 76 have a first end portion 78 and a second end portion 80. First and second support members 74 and 76 are generally provided to support the arm support member 56 in either a first or inclined position (FIGS. 2 and 5) or a second or flat position (FIGS. 3 and 6) by providing a counter rotational force to that applied to the arm support member 56 when the person's arms are resting thereon. First and second support members 74 and 76 may take a variety of forms. By way of example only, the first and second support members 74 and 76 may consist of a polymer material that will act as a "spring" and allow tension or compression of the first and second support members 74 and 76 when either stretched or compressed, thereby having a resilience sufficient to apply a counter rotational force. By way of further example, the first and second support members 74 and 76 may be a single member and/or consist of a telescopically tubular or piston structure that can be stretched or compressed to applying a resilience sufficient to apply a counter rotational force. With respect to the first support member 74 and depending upon the structure of the first support member 74, the first end portion 78 is engaged (or rotatably engaged) with the upper member 44 while the second end portion 80 may be engaged (or rotatably engaged) with the end portion 62 of the first arm portion 58. Similarly and with respect to the second support member 76, the first end portion 78 is engaged (or rotatably engaged) with the upper member 44 and the second end portion 80 is engaged (or rotatably engaged) with the end portion 62 of the second arm portion 60. The first and second arm portions 58 and 60 are substantially rigid to oppose counter-rotation of the arm support 56.

In operation, a person may rotate the upper member 44 and arm support member 56 from a first or inclined position (FIGS. 2 and 5) wherein the upper member 44 is substantially vertical or inclined to the median member 32 and the arm support member 56 is substantially parallel to the median member 32 thereby allowing a person to sit upright while comfortably supporting her arms and/or hands on the first and second arm portions 58 and 60 to a second or flat position (FIGS. 3 and 6) wherein both the upper member 44 and the arm support member 56 are parallel with the median member 32. The arm portions 58 and 60 are adapted to rotate either way so that a person may lie flat on her stomach and rest her arms forward of her head or rearward of her head.

Figure 8:
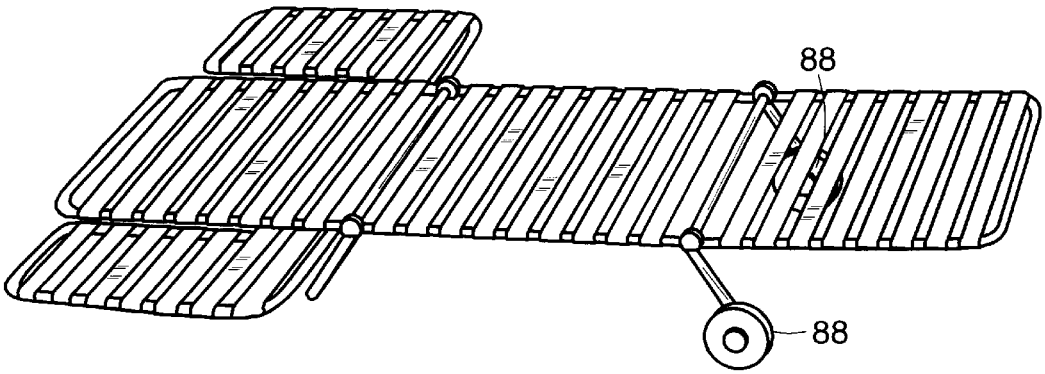
FIG. 8 is a perspective view of a second embodiment of a lounge chair of the present invention showing the addition of wheels so that the lounge chair can be rolled.

Referring to FIG. 8, wherein a second embodiment of a lounge chair of the present invention is showing with the addition of wheels 88 so that the lounge chair can be rolled.

Figure 9:
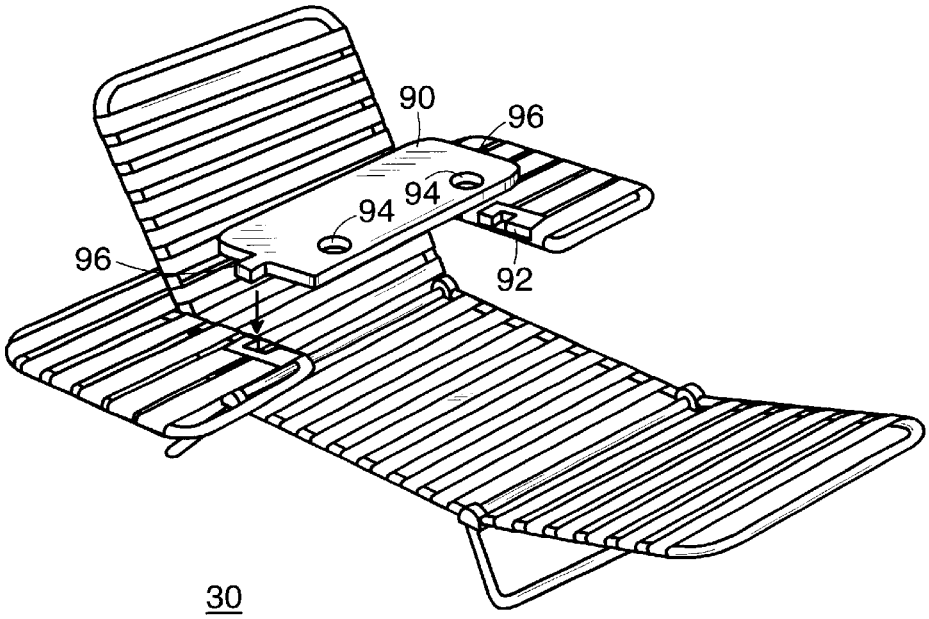
FIG. 9 is a perspective view of another embodiment of the lounge chair of the present invention showing the addition of removable table and cup holders.

Referring to FIG. 9, wherein another embodiment of the lounge chair 30 of the present invention is shown with the addition of a table 90 which is removeably engaged with the first and second arm portions 58 and 60. In the embodiment shown, the table 90 comprises end portions 96 which engage with channel portions 92 formed in the first and second arm portions 58 and 60. The table 90 may also comprise cup holders 94. Alternatively, the cup holders 94 could be positioned within each of the first and second arm portions 58 and 60 and adapted to receive and/or secure a cup irrespective of the orientation of the first and second arm portions 58 and 60.

Referring to FIG. 10, wherein another embodiment of the lounge chair 30 of the present invention shows the addition of a pouch 98 affixed to the lower member 38 for storing the arm support member 56 during storage and/or transportation of the lounge chair 30.

Although not shown, a hood or cover may be attached to the upper member 44 to reduce the exposure to the sun.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed:

1. A lounge chair for use by a person comprising:

a) a median member having first and second end portions;

b) a lower member engaged with said median member;

c) an upper member engaged with said median member, said upper member having first and second side portions;

d) an arm support member comprising first and second arm portions and a base portion forming a substantially U-shaped configuration, said first and second arm portions rotatably engaged with said upper member at said base portion, said arm support member comprising said first and second arm portions disposed adjacent to said first and second side portions, respectively, said first and second arm portions each comprising a first surface and a second surface, said first and second surfaces being substantially adjacent and parallel to each other; and e) said arm support member moveable from a first position wherein said upper member is inclined to said median member and said first and second arm portions are substantially parallel to said median member with said first surfaces facing upward to allow a person to sit upright while supporting her arms on said first surfaces of said first and second arm portions to a second position wherein said upper member is rotated relative to the median member and said arm support member is rotated relative to the median member and the upper member such that the upper member and said first and second arm portions are substantially parallel with said median member, and said second surfaces of said first and second arm portions facing upward to support the arms of said person in a reclined position.

2. The lounge chair of claim 1, wherein said arm support member is removably engaged with said upper member and can be folded for storage.

3. The lounge chair of claim 2, wherein said first and second surfaces of said first and second arm portions are substantially planar.

* * * * *